US005642829A

United States Patent [19]

Hardison

[11] Patent Number: 5,642,829

[45] Date of Patent: Jul. 1, 1997

[54] CONTAINERS

[75] Inventor: Stewart Hardison, Bainbridge, N.Y.

[73] Assignee: Perky-P Co., A Colorado Partnership, Denver, Colo.

[21] Appl. No.: 650,913

[22] Filed: May 17, 1996

[51] Int. Cl.[6] ..... B65D 21/00

[52] U.S. Cl. ..... 220/4.22; 220/491

[58] Field of Search ..... 220/4.22, 4.21, 220/491, 485

[56] References Cited

U.S. PATENT DOCUMENTS

| | | | |
|---|---|---|---|
| 1,463,124 | 7/1923 | McConnell | 220/491 |
| 1,849,505 | 3/1932 | Ondrasik, Jr. | 220/491 |
| 1,865,533 | 7/1932 | Lutzke | 220/491 |
| 2,846,941 | 8/1958 | Goodwin | 220/491 |
| 3,188,939 | 6/1965 | Smith | 220/491 |
| 4,431,408 | 2/1984 | Postich | 220/491 |
| 4,756,505 | 7/1988 | Vegas | 220/491 |

*Primary Examiner*—Joseph M. Moy

*Attorney, Agent, or Firm*—Richard G. Stephens

[57] ABSTRACT

An article container is formed by two generally interlocking wire sheet pieces which fold together in clamshell fashion to provide a container for articles to which access may be had.

3 Claims, 3 Drawing Sheets

CONTAINERS

My invention relates to latchable containers and methods for making the same, and more particularly to economical and durable latchable containers having a variety of practical uses and methods for making the same. While basic aspects of the invention were conceived in connection with fashioning an improved form of bird feeder, it will be come apparent as the description proceeds that containers constructed in accordance with the invention will find numerous uses in a wide variety of fields. For example, the invention may be employed as a soap container in a bath or shower area, or used in kitchens to hold various condiments for drying, such as chili peppers, garlic cloves, and herbs.

One general object of the invention is to provide novel and improved forms of containers which are capable of holding various articles with substantial portions of the articles exposed. Another general object of the invention is to provide a container which can securely hold one or more of a variety of different articles yet allow a limited form of access to the held article or articles, so that one or more portions of the container contents may be removed from the container without any need for unlocking and then relocking of the container.

An important object of the invention is to provide improved containers which may be securely latched in a "locked" condition, or alternatively latched in an "unlocked" condition in which container contents all may be readily installed, or removed or replaced. One related object of the invention is to provide a container latch mechanism which is reliable yet simple and inexpensive. Another object of the invention is to provide a container which does not rattle.

Attending all the aforementioned objects is the important object of providing a container having the above-mentioned characteristics which is very simple and economical to fabricate, and durable and long-lasting. It will be seen as the description proceeds that a container may be made by applying only a few simple steps to a stock material, without a need for any expensive tooling or jigs and fixtures, and hence the containers can be made by unskilled workers.

The invention accordingly comprises the features of construction, combinations of elements, and arrangements of parts, which will be exemplified in the construction set forth, and the scope of the invention will be indicated in the claims.

As will become clear below, the container of the invention is made by forming and assembling a few pieces of a known form of wire mesh. The present invention is not the first attempt to make bird feed containers by forming such wire mesh. In one prior attempt of which I am aware, a rectangular strip of wire mesh was first folded at three places along its length, and the ends of the strip then banded together to provide a four-sided open-ended box. Then two further strips of the wire mesh were banded on the two open ends, one of the end strips being permanently affixed on several sides to the four-sided box, but with only one edge of the other end strip banded to the four-sided box, so that end strip could pivot, allowing one to "open" or "close" such a container.

Other objects of the invention will in part be obvious and will in part appear hereinafter.

For a fuller understanding of the nature and objects of the invention, reference should be made to the following detailed description taken in connection with the accompanying drawings, in which:

FIG. 1 is a plan view of a section of one exemplary known form of wire mesh useful in construction of the invention;

FIG. 1*a* is a plan view of a piece of wire mesh trimmed to a desired length and width preparatory to being bent into a U-shape to form the upper portion of the container shown in FIGS. 2 and 3.

FIG. 1*b* is an elevation view taken at lines 1*b*—1*b* in FIG. 1*a* after the end portions 11*b*, 11*c* of the piece shown in FIG. 1*a* have been bent downwardly at bend lines shown as dashed lines 21, 22 in FIG. 1*a*.

FIG. 1*c* is a plan view of a piece of wire mesh trimmed to a desired length and width preparatory to being bent into a U-shape to form the lower portion of the container shown in FIGS. 2 and 3.

FIG. 1*d* is an elevation view taken at lines 1*d*—1*d* in FIG. 1*c* after the end portions 12*b*, 12*c* of the piece shown in FIG. 1*c* have been bent downwardly at bend lines shown as dashed lines 23, 24 in FIG. 1*c*.

Figure 1:
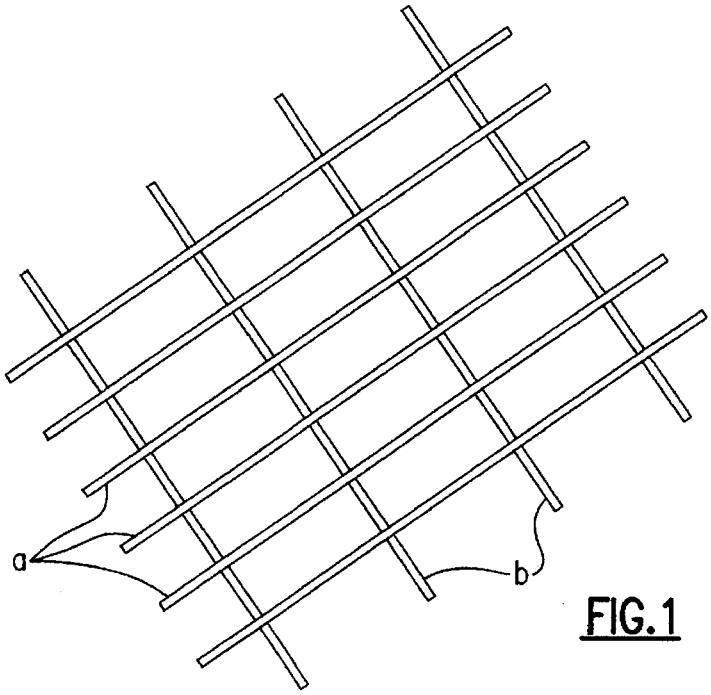

Referring to the Figures, it first should be noted that the preferred form of the invention thereshown may be constructed using an extremely small number (e.g. only four) parts, and of those four only two need be specially formed. FIG. 1 shows a section of well-known commercially available wire mesh comprising a first set of mutually spaced apart and mutually parallel wires a,a all situated in a first common plane, and a second set of mutually spaced apart and mutually parallel wires b,b all situated in a second common plane which is parallel to and adjacent or touching the first plane, with the wires of the first set extending in a direction perpendicular to those of the second set. Wherever a wire a of the first set crosses a wire b of the second set the wires are tack or spot welded together. Such wires so welded together has substantial rigidity as a sheet. In one satisfactory embodiment of the invention the wires a,a had the same diameter and other characteristics as the wires b,b with that diameter being approximately 0.016 inch (0.406 mm.), the wires a,a were spaced on 0.5 in. (1.27 cm.) centers, and the wires b,b were spaced on 1.00 in. (2.54 cm.) centers.

Figure 2:
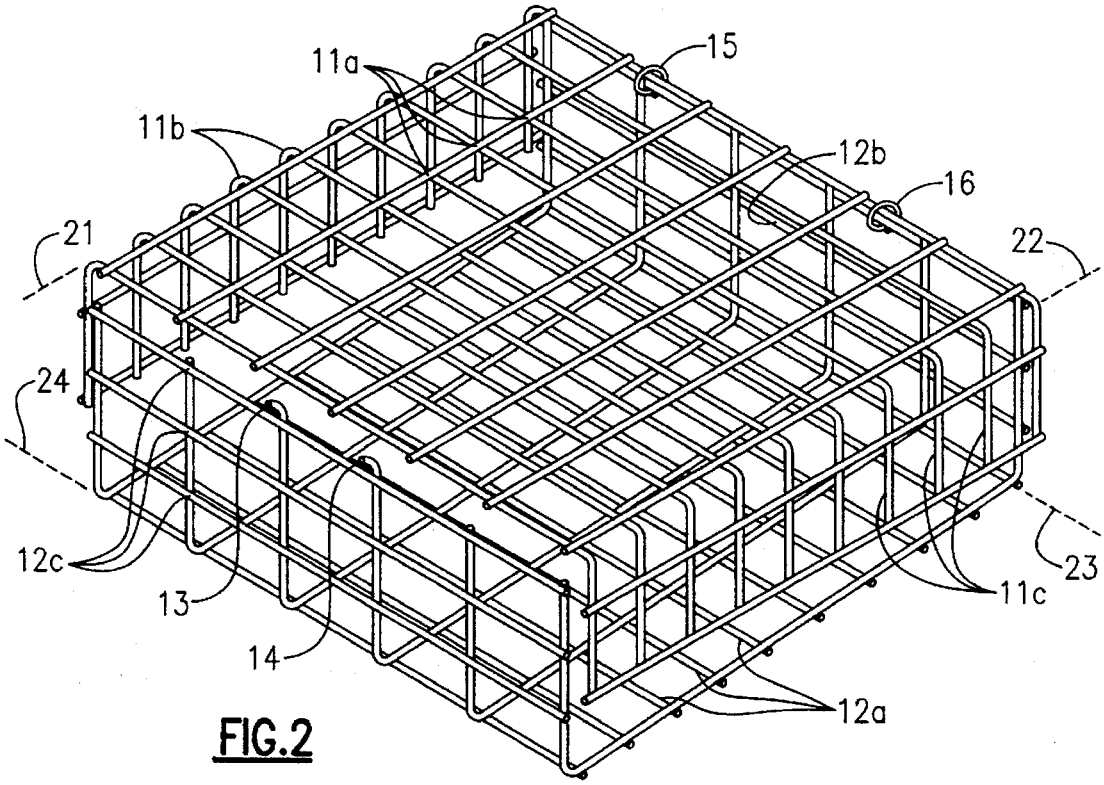
FIG. 2 is an isometric view of a preferred form of the invention shown in an "unlocked" or "unlatched" condition.
Figure 1A:
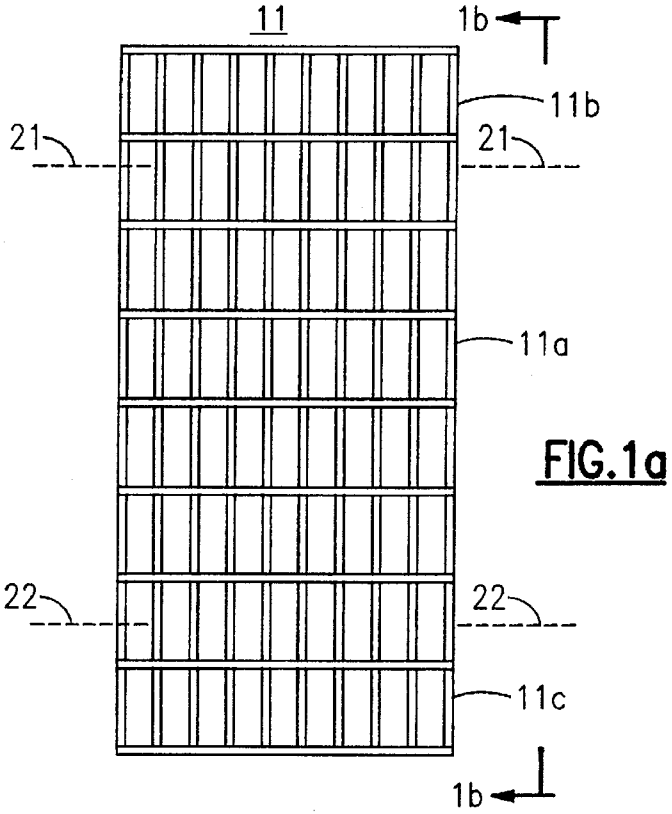
Figure 1B:
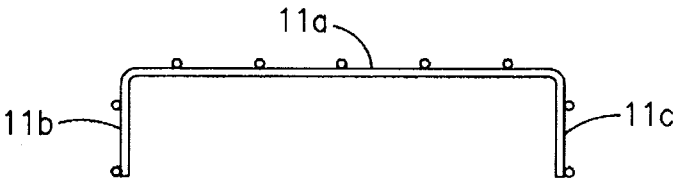
Figure 1C:
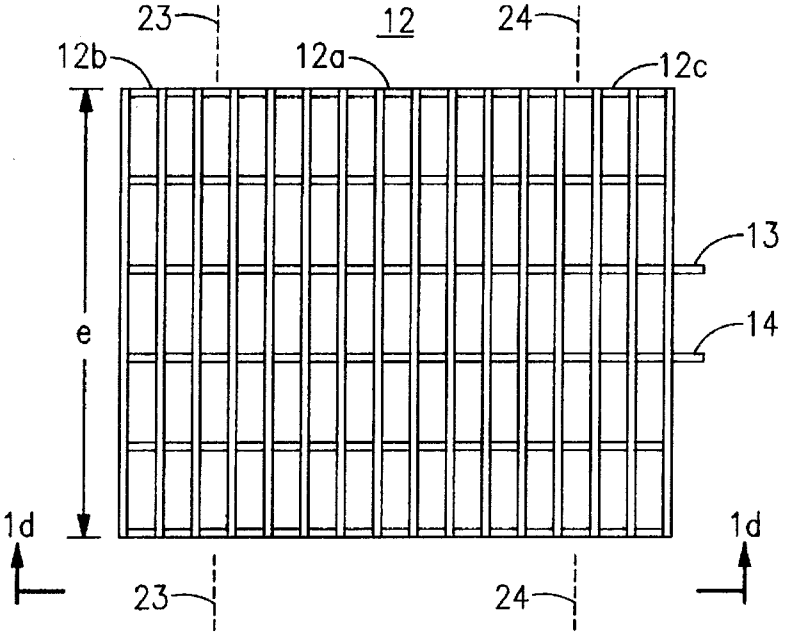
Figure 1D:
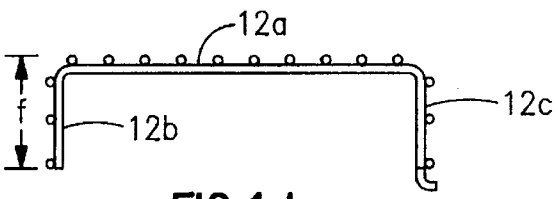
Figure 3:
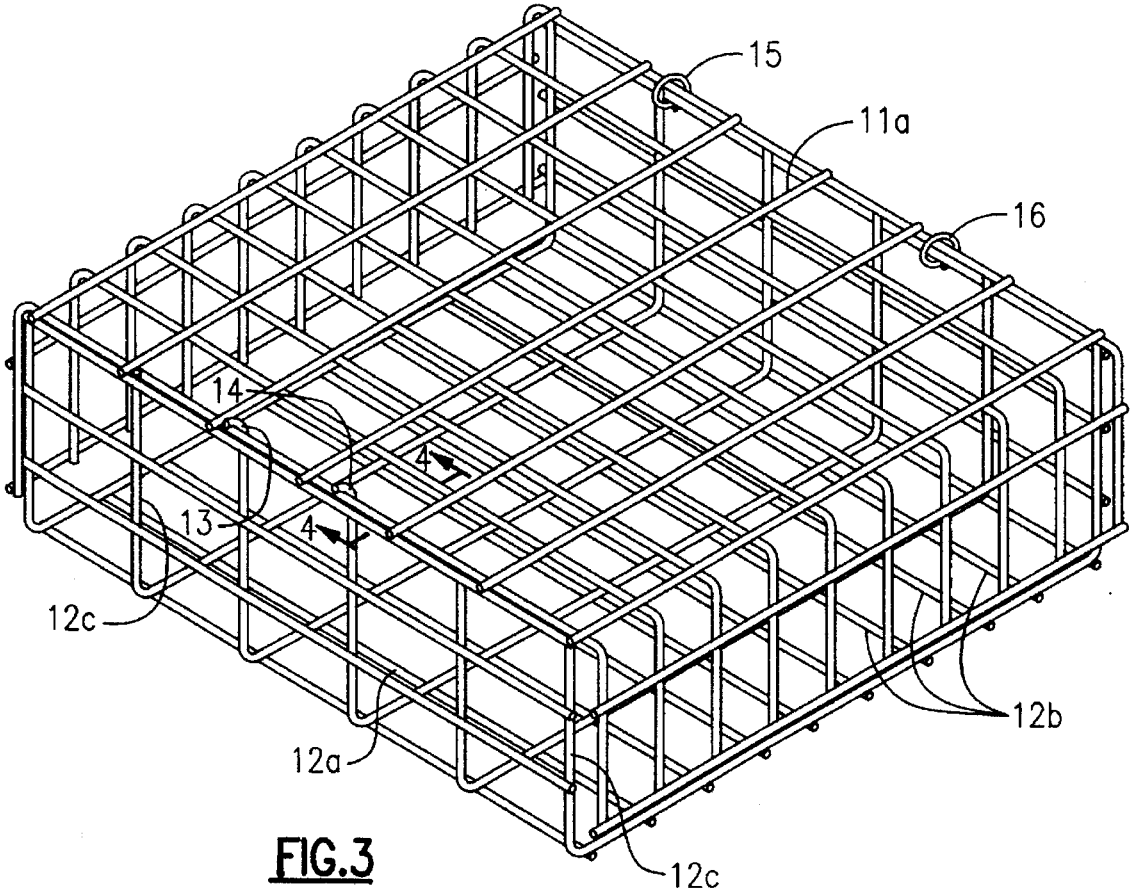
FIG. 3 is an isometric view showing the device of FIG. 2 in a "locked" or "latched" condition.
Figure 4:
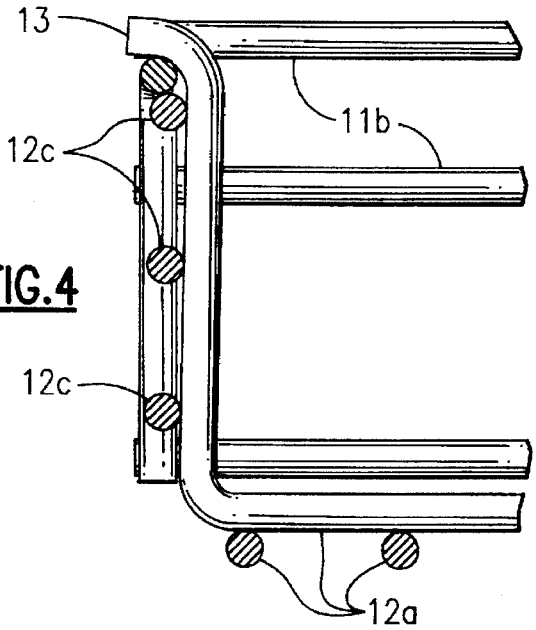
FIG. 4 is a sectional elevation view taken at lines 4—4 in FIG. 3.

In order to construct the form of the invention shown in FIGS. 2 and 3, two pieces of wire mesh 11 (FIG. 1*a*) and 1 (FIG. 1*c*) of the above-described type are each simply sheared to a desired length and width and then bent to a U-shape, i.e., two 90° C. bends made in each strip. In FIG. 1*a* piece 11 of wire mesh is shown cut to a desired length and width in a flat condition preparatory to end portions 11*b* and 11*c* being bent 90° C. (downwardly as viewed in FIGS. 1*a* and 1*c*). In FIG. 1*c* piece 12 of wire mesh is shown cut to a desired length and width and in a flat condition preparatory to its end portions 12*b* and 12*c* being bent (downwardly as viewed in FIGS. 1*c* and 1*d*). In FIGS. 2 and 3 top portion 11 of the container thereshown comprises a top portion 11*a*, and end portions 11*b* and 11*c*. The strip of wire sheet bent to form top piece 11 is sheared so that each of its a wires terminates adjacent one or another of the terminal b wires of the strip. The strip of wire sheet utilized to form bottom portion 12 of the device is formed similarly in a U-shape, to provide a top portion 12*a*, and side portions 12*b*, 12*c*. However, the strip of mesh used for part 12 is sheared so that one or more (two are shown, at 13, 14) b wires at one end of the strip project slightly past one terminal a wire of that strip, and are bent at an acute angle approximating 90 degrees.

As shown in FIGS. 2 and 3, the two U-shaped elements 11, 12 are rotatably fastened together by two simple one-turn wire rings 15, 16 which allow elements 11, 12 to rotate relative to each other. The simple rings 15, 16 advantageously provide a loose rotary attachment of the U-shaped pieces, so that they may be relatively rotated with ease when the device is not latched. The length of the element 12 is made such that when the device is unlatched, end 12*c* lies beyond the edge of central portion 11*a*. However, by merely urging end 12*c* inwardly, against the natural resilience of the strip while moving elements 11, 12 toward a closed position, finger portions 13, 14 may be moved behind the adjacent a wire at the edge of portion 11*a*, and on release the resilience of the bent wire mesh element 12 causes fingers 13, 14 to firmly engage the mentioned a wire, holding the device latched or locked. It should be noted that the resilience of element 12 takes up the slack caused by the over-sizing of rings 15, 16, and hence no portion of the device is loose to rattle after the device is locked. The contents which the user inserts in the container may or may not rattle, of course, depending upon what those contents are.

It will thus be seen that the objects set forth above, among those made apparent from the preceding description, are efficiently attained, and since certain changes may be made in the above constructions without departing from the scope of the invention, it is intended that all matter contained in the above description or shown in the accompanying drawing shall be interpreted as illustrative and not in a limiting sense.

The embodiments of the invention in which an exclusive property or privilege is claimed are defined as follows:

1. A container comprising first and second generally U-shaped pieces formed from substantially planar wire mesh having a pair of rows of wire extending in mutually perpendicular directions, each of said U-shaped pieces having a central length and leg lengths at opposite ends of the central length;

and means for attaching together two edges of the central lengths of the two pieces to allow rotation of said pieces relative to each other about a hinge axis, at least one of said wires in one of said rows of one of said pieces extending to be capable upon relative rotation of said first and second pieces of resiliently engaging a wire of said rows of said second piece to lock said two pieces together.

2. A container according to claim 1 in which said means for attaching includes at least one wire ring.

3. A container according to claim 1 wherein a plurality of wires in said rows of said one of said pieces each extend to engage a wire of said second piece.

* * * * *